US005188406A

United States Patent [19]

Sterzenbach et al.

[11] Patent Number: 5,188,406

[45] Date of Patent: Feb. 23, 1993

[54] MOTOR-VEHICLE DOOR LATCH

[75] Inventors: Horst W. Sterzenbach, Ratingen; Frank Kleefeldt, Heiligenhaus, both of Fed. Rep. of Germany

[73] Assignee: Kiekert GmbH & Co. Kommanditgesellschaft, Heiligenhaus, Fed. Rep. of Germany

[21] Appl. No.: 822,467

[22] Filed: Jan. 17, 1992

[30] Foreign Application Priority Data

Jan. 24, 1991 [DE] Fed. Rep. of Germany ..... 4102049

[51] Int. Cl.[5] ..... E05C 3/26

[52] U.S. Cl. ..... 292/216; 292/210; 292/DIG. 27

[58] Field of Search ..... 292/210, 216, DIG. 23, 292/DIG. 27, 280

[56] References Cited

U.S. PATENT DOCUMENTS

| | | | |
|---|---|---|---|
| 4,219,227 | 8/1980 | Grabner et al. | 292/216 |
| 4,988,135 | 1/1991 | Ottino | 292/216 X |
| 5,092,639 | 3/1992 | Di Guisto | 292/216 |

*Primary Examiner*—Richard E. Moore

*Attorney, Agent, or Firm*—Herbert Dubno Andrew Wilford

[57] ABSTRACT

A motor-vehicle door latch has a housing, a latch fork pivotal on the housing about a latch-fork axis, engageable in a latched position with a door bolt to retain same and lock the door, and having a latching surface offset from the latch-fork axis, a main latching lever pivotal on the housing adjacent the fork about a main-lever axis substantially parallel to the latch-fork axis, and a secondary latching lever pivotal on the main lever about a secondary-lever axis substantially parallel to the latch-fork axis and having an outer end formed with a surface engaging the latch-fork surface in the latched position. A pair of stops define for the latching levers in the latched position of the latch fork a normal position with the surface in surface contact and an actuated position with the surfaces only in line contact. Thus to open the door the main lever is pivoted from the normal position to the actuated position and thereafter the latching-lever surface is slid off the latch-fork surface. Thus at the start of an unlatching or opening operation the main and secondary levers first move to reduce the contact between the secondary lever and the fork to line contact, and then slide apart.

9 Claims, 4 Drawing Sheets

MOTOR-VEHICLE DOOR LATCH

FIELD OF THE INVENTION

The present invention relates to a motor-vehicle door latch.

BACKGROUND OF THE INVENTION

A standard motor-vehicle door latch has a housing mounted on the door edge and formed with a recess into which is engageable a bolt projecting from the respective door post. A fork is pivotal in the housing between a latching position engaging around the bolt and holding it solidly in the recess and a freeing position permitting the bolt to enter and leave the recess. A latch pawl engageable with the fork can retain it in the latched position. The latch pawl in turn is controlled via appropriate levers both from an inside door handle and an outside door handle, either of which can therefore operate the latch to allow the door to be opened. A locking mechanism can uncouple the outer door handle at least from the latch pawl.

Normally in the latched position of the door a surface of the latch pawl flatly contacts a surface of the latch fork in surface contact. This solidly retains the fork in position but poses some problems when it comes to opening the latch, as there is considerable sliding friction to overcome. Since the door is normally provided with a soft elastomeric seal that serves in the closed position to seal tightly around the door, to prevent the door from rattling, and to hold the latch tight, it is fairly difficult to slide the latch pawl off the latch fork to open the door. Even when the mutually contacting surface are both formed arcuate with centers of curvature at the pivot axis for the latch pawl, the pawl tends to stick on the fork.

OBJECTS OF THE INVENTION

It is therefore an object of the present invention to provide an improved motor-vehicle door latch.

Another object is the provision of such an improved motor-vehicle door latch which overcomes the above-given disadvantages, that is which is relatively easy to open, that is where the sliding friction between the latch pawl and the latch fork is minimized.

SUMMARY OF THE INVENTION

A motor-vehicle door latch according to this invention has housing, a latch fork pivotal on the housing about a latch-fork axis, engageable in a latched position with a door bolt to retain same and lock the door, and having a latching surface offset from the latch-fork axis, a main latching lever pivotal on the housing adjacent the fork about a main-lever axis substantially parallel to the latch-fork axis, and a secondary latching lever pivotal on the main lever about a secondary-lever axis substantially parallel to the latch-fork axis and having an outer end formed with a surface engaging the latch-fork surface in the latched position. A pair of stops define for the latching levers in the latched position of the latch fork a normal position with the surfaces in surface contact and an actuated position with the surfaces only in line contact. Thus an actuating system opens the latch by pivoting the main lever from the normal position to the actuated position and thereafter slides the latching-lever surface off the latch-fork surface.

With this system, therefore, at the start of an unlatching or opening operation the main and secondary levers, which replace the traditional one-piece latch pawl, first move to reduce the contact between the secondary lever and the fork to line contact, and then these two parts can be easily slid apart. As a result there is in effect a rolling-off that takes place with very little friction, and in fact the angle the parts assume when in line contact is such that they separate very easily. The force necessary to open the latch is very reduced.

According to a feature of this invention in the normal position the latch-fork and main-lever axes define a plane passing through the surfaces where same contact each other and in the actuated position the plane does not pass through the surfaces where same contact each other. Furthermore the stops are formed on the secondary lever and the housing is provided with a latching-lever pivot defining the latching lever axis, pivotally carrying the latching lever, and coacting with the stops.

In one embodiment according to the invention the latching-lever surface is turned toward the latching-lever axis and in the latched position the latch-fork surface is turned away from the latching-lever axis. The secondary-lever axis lies between the main-lever axis and the latching-lever surface.

Alternately the latching-lever surface is turned away from the latching-lever axis and in the latched position the latch-fork surface is turned toward the latching-lever axis. The main-lever axis lies between the secondary-lever axis and the latching-lever surface.

Furthermore in accordance with the invention springs are provided engaging the latching levers and urging same into the normal position.

BRIEF DESCRIPTION OF THE DRAWING

The above and other objects, features, and advantages will become more readily apparent from the following, reference being made to the accompanying drawing in which.

SPECIFIC DESCRIPTION

Figure 1A:
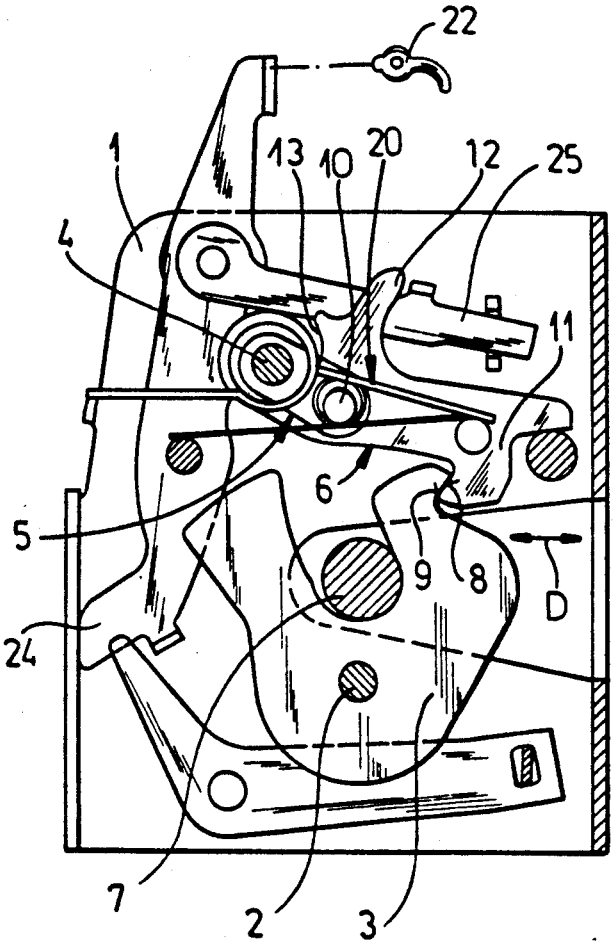
FIGS. 1A and 1B are sections taken along mutually orthogonal planes showing the latch of this invention in the latched position.
Figure 1B:
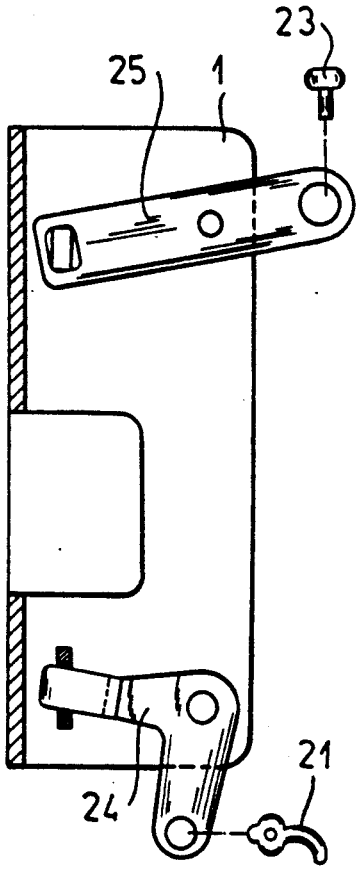

As seen in FIGS. 1A and 1B a motor-vehicle door latch according to this invention has a housing 1 normally fixed on a door edge and provided with a pivot pin 2 normally extending in the motor-vehicle travel direction and pivotally carrying a standard latch fork 3 that can engage in the illustrated latched position around a latching element or bolt 7 projecting from an edge of an unillustrated door post and movable in a direction D into and out of the housing 1. The fork 3 has a surface 9 directed generally outward in the direction D and engageable with another surface 8 of a lever system 5, 6 pivoted at 4 parallel to the latch-fork pivot 2. An inside door handle 21 and an outside door handle 22 are effective through a linkage 24 on the lever system 6 and an unlocking button 23 is effective through a linkage 25 to decouple the linkage 24 from the lever system 5, 6, as is standard in such latches.

According to this invention the lever system 5, 6, which replaces the traditional one-piece latch pawl, is formed by a main lever 5 pivoted at 4 on the housing 1 and a secondary lever 6 pivoted at 10 parallel to pivot 4 on the main lever 5. This secondary lever 6 is itself constituted as a two-arm lever having one arm 11 forming the surface 8 and another arm 12 operable through the linkages 24 and 25 by the handles 21 and 22. The lever 6 is formed with a pair of stops 14 and 15 defining a wide mouth or gap that loosely receives the pivot pin 4. Springs 20 urge the stop 14 into contact with the pin 4.

Figure 2:
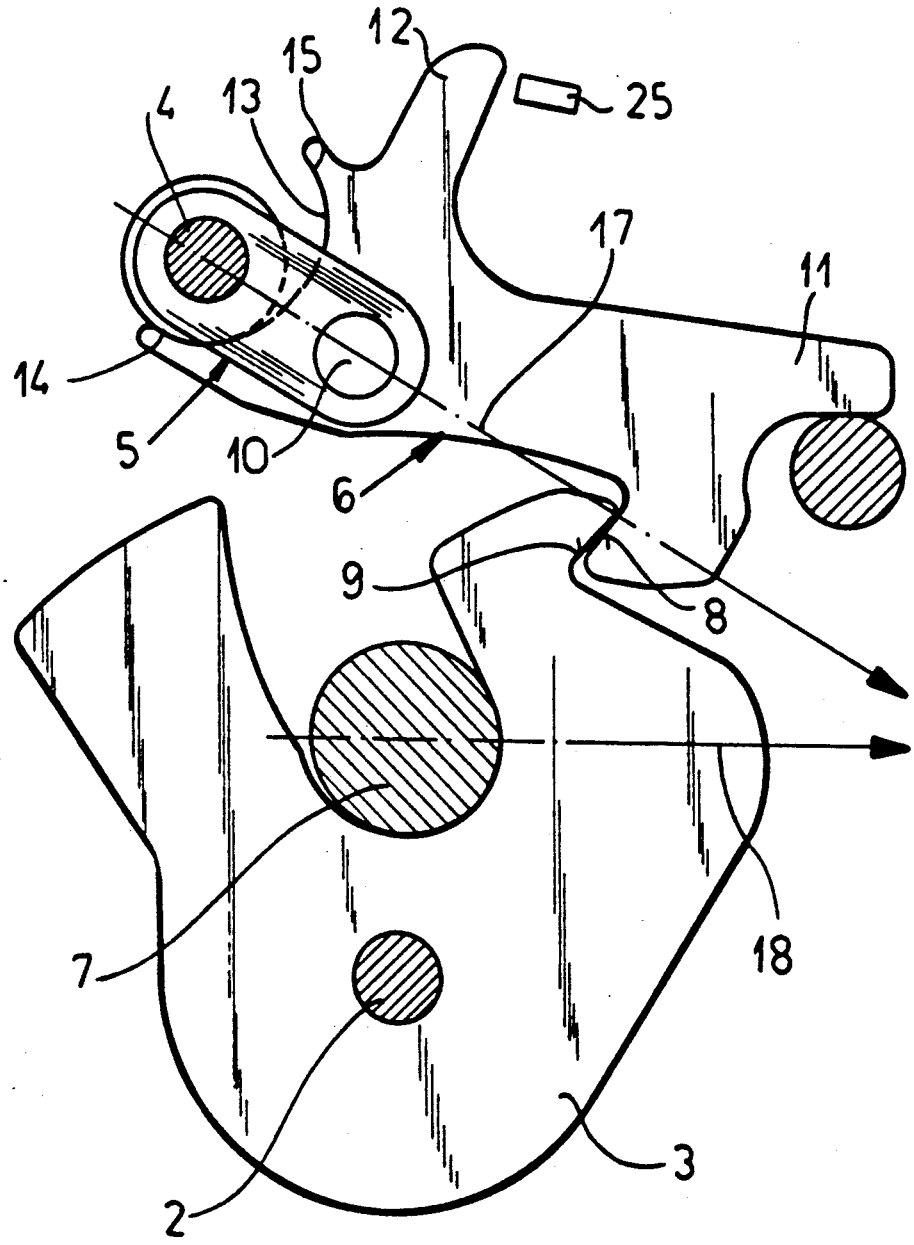
FIGS. 2 and 3 are large-scale views of elements of the latch in the normal latched position and at the start of an unlatching operation.

In the latched position shown in FIG. 2 the two surfaces 8 and 9 engage each other in surface contact and a plane 17 formed by the axes of the pivots 4 and 10 passes through the region of contact. This is therefore a very stable position, which is in fact the one the system is urged into by the springs 20. In this position the stop 14 rests against the pivot pin 14.

Figure 3:
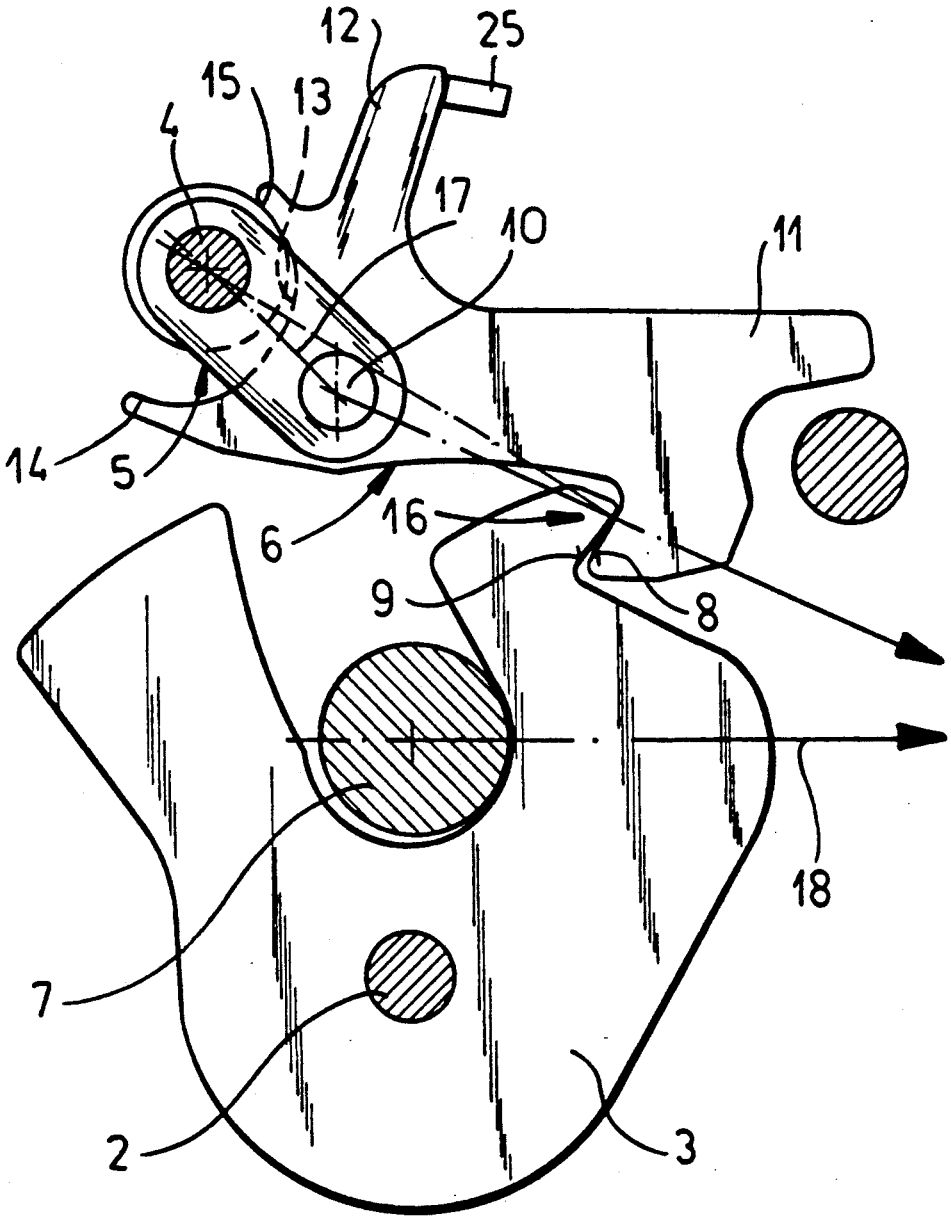

To unlock the door the arm 12 is pushed inward, that is to the left in FIGS. 2 and 3 so as to relatively pivot the levers 5 and 6 about the axis 10 and move the stop 14 over into engagement with the pin 4. This has two effects: it moves the plane 17 so that it no longer extends through where the surfaces 8 and 9 contact each other, and it also rocks the surfaces 8 and 9 on each other so that they are only in line contact at 16 as illustrated in FIG. 3. This greatly reduces the friction between the surfaces 8 and 9 so that on further counterclockwise pivoting of the lever 6 the surfaces 8 and 9 roll out of contact with each other and the fork 3 is released. Such separation is facilitated as seen in FIG. 3 in that the surfaces 8 and 9 form when in line contact a small acute angle open toward the bolt 7.

Figure 4:
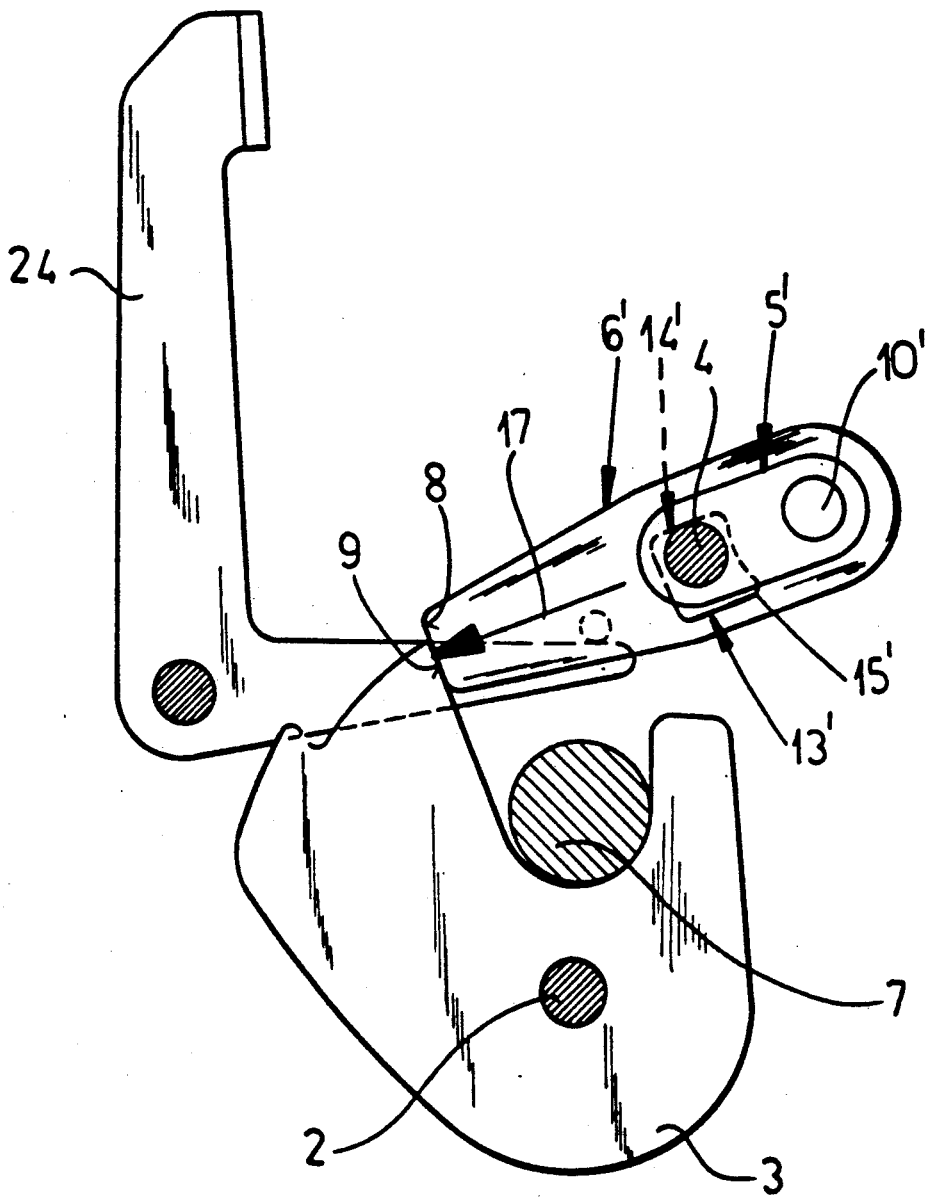
FIG. 4 is a view like FIGS. 2 and 3 of an alternative arrangement of this invention in the normal latched position.

In FIG. 4 the kinematics operate similarly to those of the system of FIGS. 1 through 3, but here levers 5' and 6' are effective in compression, not in tension. More particularly the pin 4 is located between the pivot 10' and the surfaces 8 and 9 and the lever 6' is formed with a window through which the pivot pin 4 extends and that forms the stops 14' and 15' in turn forming the gap 13'. This system functions identically to that of FIGS. 1 through 3.

We claim:

1. A motor-vehicle door latch comprising:

a housing provided with a pivot defining a main latch-ing-lever axis;

a latch fork pivotal on the housing about a latch-fork axis substantially parallel to the main-lever axis, engageable in a latched position with a door bolt to retain same and lock the door, and having a latching surface offset from the latch-fork axis;

a main latching lever pivotal on the pivot of the housing adjacent the fork about the main-lever axis;

a secondary latching lever pivotal on the main lever about a second-lever axis substantially parallel to the latchfork axis and having an outer end formed with a surface engaging the latch-fork surface in the latched position;

a pair of stops formed on the second lever, coacting with the pivot, and defining for the latching levers in the latched position of the latch fork a normal position with the surfaces in surface contact and an actuated position with the surfaces only in line contact; and actuating means for opening the latch by pivoting the main lever from the normal position to the actuated position and thereafter for sliding the latching-lever surface off the latchfork surface.

2. The motor-vehicle door latch defined in claim 1 wherein in the normal position the latch-fork and main-lever axes define a plane passing through the surfaces where same contact each other and in the actuated position the plane does not pass through the surfaces where same contact each other.

3. The motor-vehicle door latch defined in claim 1 wherein the latching-lever surface is turned away from the secondary-lever axis and in the latched position the latch-fork surface is turned toward the latching-lever axis.

4. The motor-vehicle door latch defined in claim 1, further comprising:

spring means engaging the latching levers and urging same into the normal position.

5. A motor-vehicle door latch comprising:

a housing;

a latch fork pivotal on the housing about a latch-fork axis, engageable in a latch position with a door bolt to retain same and lock the door, and having a latching surface offset from the latch-fork axis;

a main latching lever pivotal on the housing adjacent the fork about a main-lever axis substantially parallel to the latch-fork axis;

a secondary latching lever pivotal on the main lever about a secondary-lever axis substantially parallel to the latchfork axis and having an outer end formed with a surface engaging the latch-fork surface in the latched position and turned toward the latching-lever axis, in the latched position the latchfork surface being turned away from the latching-lever axes;

a pair of stops defining for the latching levers in the latched position of the latch fork a normal position with the surfaces in surface contact and an actuated position with the surfaces only in line contact; and actuating means for opening the latch by pivoting the main lever from the normal position to the actuated position and thereafter for sliding the latching-lever surface off the latch-fork surface.

6. The motor-vehicle door latch defined in claim 5 wherein the stops are formed on the secondary lever, the housing being provided with a latching-lever pivot defining the main-lever axis, pivotally carrying the latching lever, and coacting with the stops.

7. The motor-vehicle door latch defined in claim 5 wherein the secondary-lever axis lies between the main-lever axis and the latching-lever surface.

8. The motor-vehicle door latch defined in claim 3 wherein the main-lever axis lies between the secondary-lever axis and the latching-lever surface.

9. A motor-vehicle door latch comprising:

a housing;

a latch fork pivotal on the housing about a latch-fork axis, engageable in a latched position with a door bolt to retain same and lock the door, and having a latching surface offset from the latch-fork axis;

a main latching lever pivotal on the housing adjacent the fork about a main-lever axis substantially parallel to the latch-fork axis, the latching-lever surface being turned away from the main latching-lever axis, the latch-fork surface being turned toward the main-lever axis in the latched position of the fork;

a secondary latching lever pivotal on the main lever about a secondary-lever axis substantially parallel to the latch-fork axis and having an outer end formed with a surface engaging the latch-fork surface in the latched position, the main-lever axis lying between the secondary-lever axis and the latching-lever surface;

a pair of stops defining for the latching levers in the latched position of the latch fork a normal position with the surfaces in surface contact and an actuated position with the surfaces only in line contact; and actuating means for opening the latch by pivoting the main lever from the normal position to the actuated position and thereafter for sliding the latching-lever surface off the latch-fork surface.

* * * * *